US007986291B2

(12) United States Patent
Van Mourik et al.

(10) Patent No.: US 7,986,291 B2
(45) Date of Patent: Jul. 26, 2011

(54) METHOD OF DRIVING DISPLAYS COMPRISING A CONVERSION FROM THE RGB COLOUR SPACE TO THE RGBW COLOUR SPACE

(75) Inventors: Johannes Gerardus Rijk Van Mourik, Eindhoven (NL); Jeroen Hubert Christoffel Jacobus Stessen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1035 days.

(21) Appl. No.: 11/814,493

(22) PCT Filed: Jan. 19, 2006

(86) PCT No.: PCT/IB2006/050209

§ 371 (c)(1),
(2), (4) Date: Jul. 23, 2007

(87) PCT Pub. No.: WO2006/077554

PCT Pub. Date: Jul. 27, 2006

(65) Prior Publication Data

US 2008/0204480 A1 Aug. 28, 2008

(30) Foreign Application Priority Data

Jan. 24, 2005 (EP) ..... 05100409

(51) Int. Cl.
*G09G 3/36* (2006.01)

(52) U.S. Cl. ..... 345/88

(58) Field of Classification Search ..... 345/82, 345/88, 690

See application file for complete search history.

(56) References Cited

U.S. PATENT DOCUMENTS 5,592,188 A 1/1997 Doherty et al.

(Continued)

FOREIGN PATENT DOCUMENTS

EP 1104923 A2 6/2001

(Continued)

OTHER PUBLICATIONS

Baek-Woon Lee, et al: 9.2: Implementation of RGBW Color System in TFT-LCSs 2004 SID International Symposium, May 25, 2004, pp. 111-113, XP007011810.

(Continued)

*Primary Examiner* — Regina Liang
*Assistant Examiner* — Tom V Sheng

(57) ABSTRACT

An apparatus (200) for driving a display (310, 320) including an array of display elements (20), each element (20) comprising a plurality of sub-pixels of red (R), green (G), blue (B) and white (W) colors. The apparatus (200) comprising a processor (300) operable: (a) to receive input signals (RI, GI, BI) for controlling red, green and blue colors of each element (20) of the display (320); (b) to process the input signals (RI, GI, BI) to generate corresponding red, green, blue and white output drive signals for the red (R), green (G), blue (B) and white (W) sub-pixels of each element (20), said output drive signals being enhanced according to a gain factor (HS) for increasing element luminosity subject to potential color saturation occurring at one or more of the elements (20) being addressed by selectively reducing color saturation at said one or more of said elements (20); and (c) to apply said output drive signals to respective sub-pixels (R; G, B, W) for each element (20) of the display (320).

11 Claims, 5 Drawing Sheets

U.S. PATENT DOCUMENTS

| | | | | |
|---|---|---|---|---|
| 5,929,843 | A | 7/1999 | Tanioka | |
| 6,453,067 | B1 | 9/2002 | Morgan et al. | |
| 7,027,105 | B2 * | 4/2006 | Lee et al. | 348/687 |
| 7,151,517 | B2 * | 12/2006 | Lee | 345/88 |
| 7,277,075 | B1 * | 10/2007 | Hirano et al. | 345/89 |
| 7,483,011 | B2 * | 1/2009 | Yang et al. | 345/88 |
| 7,619,637 | B2 * | 11/2009 | Higgins et al. | 345/604 |
| 7,705,810 | B2 * | 4/2010 | Choi et al. | 345/77 |
| 2002/0150092 | A1 | 10/2002 | Bontempi et al. | |
| 2003/0128872 | A1 | 7/2003 | Lee et al. | |
| 2004/0046725 | A1 | 3/2004 | Lee | |
| 2004/0222999 | A1 * | 11/2004 | Choi et al. | 345/589 |
| 2004/0223005 | A1 | 11/2004 | Lee | |
| 2004/0251821 | A1 | 12/2004 | Cok | |
| 2007/0052984 | A1 * | 3/2007 | Jeong et al. | 358/1.9 |

FOREIGN PATENT DOCUMENTS

| | | | |
|---|---|---|---|
| EP | 1227687 | A2 | 7/2002 |
| WO | 0137249 | A2 | 5/2001 |
| WO | 0137251 | A1 | 5/2001 |
| WO | 2006077554 | A2 | 7/2006 |

OTHER PUBLICATIONS

Baek-Woon Lee, et al: 40.5L: Late-News Paper: TFT-LCD with RGBW Color System, Samsung Electronics Corp. SID 2003, Digest of Technical Papers, pp. 1212-1215.

* cited by examiner

METHOD OF DRIVING DISPLAYS COMPRISING A CONVERSION FROM THE RGB COLOUR SPACE TO THE RGBW COLOUR SPACE

FIELD OF THE INVENTION

The present invention relates to methods of driving displays comprising arrays of elements. Moreover, the invention also relates to displays comprising arrays of elements operating according to the methods. The present invention is not only applicable to liquid crystal displays (LCDs) but also can be employed with other types of display, for example actuated mirror displays as described in a U.S. Pat. No. 5,592,188 (Texas Instruments).

BACKGROUND TO THE INVENTION

Color LCDs most commonly in contemporary general use comprise a two-dimensional array of display elements, each element including red (R), green (G) and blue (B) sub-pixels employing associated color filters. Each such element is operable to display potentially all colors, but the color filters of each element absorb in the order of ⅔ of light passing through it. In order to increase element optical transmittance, it is known practice in the art to add a white sub-pixel (W) to each element in a manner as depicted in FIG. 1 wherein a three-sub-pixel element is indicated by 10, and a four-sub-pixel element including a white (W) sub-pixel is indicated by 20.

In the element 20, the red (R), green (G) and blue (B) sub-pixels each have an area which is 75% of that of a corresponding color sub-pixel included in the element 10. However, the white (W) sub-pixel of the element 20 does not include a color filter therein and in operation is able to transmit an amount of light corresponding to a sum of light transmissions through the red (R), green (G) and blue (B) sub-pixels of the element 20. Thus, the element 20 is capable of transmitting substantially 1.5 times more light than the element 10. Such enhanced transmission is of benefit in LCDs employed to implement television, in lap-top computers where increased display brightness is desired, in projection television (rear and front view, LCD and DLP), in lap-top computers where increased display brightness is desired, in lap-top computers where highly energy-efficient back-lit displays are desired to conserve power and thereby prolong operating time per battery charge session, and in LCD/DLP graphics projectors (beamers). However, introduction of the white (W) sub-pixel into the element 10 to generate the element 20 introduces a technical problem regarding optimal drive to the R, G, B, W sub-pixels of each element 20 to provide optimal rendition of a color image on the display.

Liquid crystal displays (LCDs) each comprising an array of elements, wherein each element includes red (R), green (G), blue (B) and white (W) sub-pixels, are described in a published U.S. patent application No. US2004/0046725. Moreover, the displays described each also includes gate lines for transmitting gate signals to their sub-pixels, and data lines for transmitting data signals to their sub-pixels. The displays described each further includes a gate driver for supplying gate signals to the gate lines, a data driver for supplying data voltages to the data lines, and an image signal modifier. The image signal modifier includes a data converter for converting three-color image signals into four-color image signals, a data optimizer for optimizing the four-color image signals from the data converter, and a data output unit supplying the optimized image signals to the data driver in synchronization with a clock.

Regimes for driving the four red (R), green (G), blue (B), and white (W) sub-pixels of each element are known. In a known "Min-simple" regime, such regime representing a simplest driving method, display input signals Ri, Gi, Bi for red, green, blue colors respectively are mapped to corresponding output signals for driving red (R), green (G), blue (B) sub-pixels respectively, these output signals being denoted by Ro, Go, Bo respectively. In the "Min-simple" regime, a minimum of the input signals Ri, Gi, Bi is computed for each element to generate a drive signal Wo for the white (W) sub-pixel thereof. In this "Min-simple" regime, a first set of equations (Eqs. 1) pertain:

$$Wo=\min(Ri, Gi, Bi)\ Ro=Ri$$

$$Go=Gi\ Bo=Bip \qquad \text{Eqs. 1}$$

wherein min(x, y, z) is a function identifying a minimum value of arguments x, y and z. When the first set of equations (Eqs. 1) is employed, the input signals Ri, Gi, Bi=240, 160, 120 respectively results in the output signals such that Ro, Go, Bo, Wo=240, 160, 120, 120 respectively. A total RGB optical color output from all four sub-pixels of the element 20 then becomes Rt, Gt, Bt=360, 280, 240. A comparison of the input signals Ri, Gi, Bi to the optical color achieved Rt, Gt, Bt shows an enhanced brightness but with a decreased color saturation for all but white, grey and fully saturated colors in an image presented; such distortion of color rendition represents a technical problem addressed by the present invention.

In another known regime denoted by "Min−1", the output signals Ro, Go, Bo are modified in order to keep the ratio between R, G, B constant. A maximum value for the output signals Ro, Go, Bo is not changed by such an approach, but values of non-maximal components do become modified. In the "Min−1" regime, a set of equations (Eqs. 2) pertains:

$$Max=\max(Ri, Gi, Bi)\ Min=\min(Ri, Gi, Bi)\ Wo=Min$$

$$Ro=[Ri*(Wo+Max)/Max]-Wo$$

$$Go=[Gi*(Wo+Max)/Max]-Wo$$

$$Bo=[Bi*(Wo+Max)/Max]-Wo \qquad \text{Eqs. 2}$$

For example, the input signals Ri, Gi, Bi=240, 160, 120 respectively result in the output signals Ro, Go, Bo, Wo=240, 120, 60, 120 respectively resulting in a total color output of Rt, Gt, Bt=360, 240, 180 respectively. This "Min−1" regime provides enhanced brightness whilst maintaining correctly a ratio between colors, thus color saturation does not change. Hence, the "Min−1" regime is operable to provide more satisfactory results in comparison to the aforementioned "Min−simple" regime.

In the "Min−1" regime, a value for the output Wo for the white (W) sub-pixel is simply derived from a minimum of the input signals Ri, Gi, Bi. Known "Min−2" and "Min−3" regimes are similar to the "Min−1" regime except that the output Wo for the white (W) sub-pixel is calculated from Equation 3 (Eq. 3) and Equation 4 (Eq. 4) respectively:

$$Wo=255\ (\mathrm{Min}/255)^2 \qquad \text{Eq. 3}$$

$$Wo=-\mathrm{Min}^3/255+\mathrm{Min}^2/255+\mathrm{Min} \qquad \text{Eq. 4}$$

The "Min−2" regime is operable to enhance highlights in color images presented on a corresponding LCD, whereas the "Min−3" regime is operable to enhance mid-tones in images presented on the LCD.

Alternatively, in a "MaxW" regime derived from the aforementioned "Min−1" regime, a value for the output Wo for driving the white (W) sub-pixel is derived from conditions as defined in Equations 5 (Eqs. 5):

$$Wo=(\text{Min}*\text{Max})/(\text{Max}-\text{Min}) \text{ when min/max}<=0.5$$

$$Wo=\text{Max when min/max}>0.5 \qquad \text{Eqs. 5}$$

For example, when using the MaxW regime, the input signals having values Ri, Gi, Bi=240, 160, 120 respectively result in the outputs Ro, Go, Bo, Wo=240, 80, 0, 240 respectively and consequently total observed color ratios Rt, Gt, Bt=480, 320, 240 respectively; in other words, brightness is enhanced and color saturation is maintained.

In a published article "TFT-LCD with RGBW Color System", Baek-woon Lee et al., Samsung Electronics Corp., Society for Information Display 2003—Digest of Technical papers, pp. 1212-1215, there is described an alternative regime to the aforesaid MaxW regime; in the alternative regime disclosed, an output for the white (W) sub-pixel is not defined and the total color output Rt, Gt, Bt is determined directly from the input signals Ri, Gi, Bi respectively pursuant to Equations 6 (Eqs.6):

$$\text{Gain}=1+\text{Min}/(\text{Max}-\text{Min}) \text{ such that Gain is limited to a value 2}$$

$$Rt=Ro+Wo=\text{Gain}*Ri$$

$$Gt=Go+Wo=\text{Gain}*Gi$$

$$Bt=Bo+Wo=\text{Gain}*Bi \qquad \text{Eqs. 6}$$

For the total colors presented by the element 20, the Rt, Gt, Bt color values are identical to that which is achievable from the aforementioned MaxW algorithm, although a specific partitioning of drive between the outputs Ro, Go, Bo and Wo is not explicitly accommodated. The formulae in Equation 6 (Eqs. 6) assume equal areas of the R, G, B, W sub-pixels in the element 20. If a parameter w is a ratio of the area of the white (W) sub-pixel in the element 20 to that of the red (R), green (G), blue (B) sub-pixels thereof, then Equations 6 (Eqs. 6) taking the parameter w into account become Equations 7 (Eqs. 7) as follows:

$$\text{Gain}=1+\text{Min}/(\text{Max}-\text{Min}) \text{ such that Gain is limited to a value } 1+w$$

$$Rt=Ro+w*Wo=\text{Gain}*Ri$$

$$Gt=Go+w*Wo=\text{Gain}*Gi$$

$$Bt=Bo+w*Wo=\text{Gain}*Bi \qquad \text{Eqs. 7}$$

In the regime employed by Samsung, it will be appreciated, for example, that for a red (R) region of a presented image represented in the input signal by Ri, Gi, Bi equal to 255, 0, 0 respectively, the regime cannot provide display enhancement. However, a less intense red region represented by the input signal, for example Ri, Gi, Bi represented by 128, 0, 0 respectively, is potentially susceptible to enhancement although it is not enhanced in such case.

The inventors have appreciated that although inclusion of the white (W) sub-pixel in the element 20 is capable of increasing corresponding display brightness, various known regimes for driving the four sub-pixels of the element 20 to obtain an optimal compromise between enhanced brightness and best color rendition suffer technical problems of overall image color rendition. The inventors have therefore devised alternative approaches for driving sub-pixels of the element 20 to at least partially address these technical problems.

SUMMARY OF THE INVENTION

An object of the present invention is to provide an alternative method of driving display elements to obtain an improved compromise between element brightness and element color rendition.

According to a first aspect of the present invention, there is provided a method of driving a display including an array of display elements, each element comprising sub-pixels of red, green, blue and white colors, said method comprising steps of:

(a) receiving input signals for controlling red, green and blue colors of each element of the display;

(b) processing the input signals to generate corresponding red, green, blue and white output drive signals for the red, green, blue and white sub-pixels of each element, said output drive signals being enhanced according to a gain factor for increasing element luminosity subject to potential color saturation occurring at one or more of the elements being addressed by selectively reducing color saturation at said one or more of said elements; and (c) applying said output drive signals to respective sub-pixels for each element of the display.

The invention is of advantage in that element brightness is increased whilst still providing acceptable color rendition.

Optionally, in the method, processing in step (b) comprises steps of:

(d) computing for each element a maximum potential optical transmission therethrough;

(e) scaling the input signals for each element according to the maximum optical transmission therethrough computed in step (d);

(f) computing a minimum value of the scaled input signals from step (e);

(g) computing intermediate signals for the scaled input signals from step (e) in relation to the minimum value from step (f) for each element;

(h) computing a maximum value of the computed intermediate signals from step (g) for each element;

(i) computing surpluses from step (g) in relation to the maximum value from step (h) for each element;

(j) computing a difference between the computed surpluses from step (i) in relation to the intermediate signals from step (g) to generate output drive signals for the red, green and blue sub-pixels of each element;

(k) computing a luminance value from the scaled computed surplus from step (i) and the minimum value from step (f); and (l) applying the luminance value from step (k) to generate the white output drive signal to control optical output of the white sub-pixel, and applying the output drive signals from step (j) to control optical output from the red, green and blue sub-pixels for each element.

Such a manner of processing the input signals to generate corresponding red, green, blue and white output drive signals for the red, green, blue and white sub-pixels of each element is of benefit in that it provides a suitable scaling for color information whilst allowing for increased sub-pixel luminosity.

Optionally, in the method, the gain factor in step (b) is made adaptive in response to the number of elements whereat color desaturation occurs. Implementing such an adaptive response enables the display to cope with high color saturation concurrent with high brightness content in images to be displayed. More optionally, in the method, the gain factor in step (b) is adaptively modified on an image frame-by-frame basis as presented on the display.

Optionally, when implementing adaptive control of the gain factor in the method, the gain factor is adaptively modified in a progressive incremented or decremented manner. Such an incremental/decremental approach circumvents sudden changes in apparent color saturation in a sequence of displayed images which may otherwise be noticeable to a viewer.

More optionally, in the method, the gain factor is progressively incremented or decremented with hysteresis. Such hysteresis circumvents further any risk of noticeable changes in color saturation (e.g. flicker) to provide an enhanced compromise between luminosity and color rendition.

Optionally, the method includes a further step of converting the input signals from a gamma-y domain to a linear domain for processing in step (b) and converting the output drive signals from the linear domain to the gamma-γ domain for driving the sub-pixels for each element. Such an additional step enables the method to cope with displays providing a non-linear conversion between drive signal and corresponding optical properties of the sub-pixels.

Optionally, when implementing the method, said processing in step (b) is substantially executed pursuant to computations comprising:

(m) converting the input signals RI, GI, BI for red, green and blue colors respectively from the gamma-y domain to corresponding parameters Ri, Gi, Bi respectively in the linear domain pursuant to:

$$Ri=(RI/Q)^{\gamma};\ Gi=(GI/Q)^{\gamma};\ Bi=(BI/Q)^{\gamma}$$

wherein Q is a number of quantization steps employed;

(n) multiplying by the gain parameter in step (b) to generate signals Rg, Gg and Bg:

Max=max(*Ri, Gi, Bi*) wherein max returns a maximum value amongst its arguments;

Min=min(*Ri, Gi, Bi*) wherein min returns a minimum value amongst its arguments;

$$GN=HS*\mathrm{Max}/(\mathrm{Max}-\mathrm{Min}),$$

wherein HS is the gain factor in step (b) and GN is limited to a value 1+A wherein GN<1+A wherein a parameter A is a relative optical transmission of the white sub-pixel relative to the sum of the red, blue and green sub-pixels $$Rg=GN*Ri\ Gg=GN*Gi\ Bg=GN*Bi;$$

(o) computing a common signal CM and therefrom signals Rs, Gs, Bs for red, green and blue colors respectively:

*CM*=min (*Rg, Gg, Bg, A*) wherein min returns a minimum value of its arguments $$Rs=Rg-CM\ Gs=Gg-CM\ Bs=Bg-CM;$$

(p) computing a maximum surplus value and performing subtractions of the surplus signals from step (m) to generate signals Rp, Gp, Bp for red, green and blue colors respectively:

Maxs=max(*Rs, Gs, Bs*)

Surplus=Maxs−1, wherein Surplus is set to zero if calculated to be less than zero $$Rsurplus=Rs*(\mathrm{Surplus}/\mathrm{Maxs})$$

$$Gsurplus=Gs*(\mathrm{Surplus}/\mathrm{Maxs})$$

$$Bsurplus=Bs*(\mathrm{Surplus}/\mathrm{Maxs})$$

$$Rp=Rs-Rsurplus\ Gp=Rs-Gsurplus\ Bp=Rs-Bsurplus;$$

(q) computing a Ysurplus signal pursuant to:

$$Ysurplus=KR*Rsurplus+KG*Gsurplus+KB*Bsurplus$$

wherein KR, KG and KB are multiplying coefficients for red, green and blue colors respectively;

(r) computing a signal Wp for controlling luminance of the white sub-pixel:

$$Wp=(CM+Ysurplus)/A;\ \text{and}$$

(s) computing the output drive signals RP, GP, BP, WP to control optical properties of the red, green, blue and white sub-pixels respectively, said output drive signals being in the gamma-γ domain pursuant to:

$$RP=Q*Rp^{1/\gamma}GP=Q*Gp^{1/\gamma}BP=Q*Bp^{1/\gamma}WP=Q*Wp^{1/\gamma}$$

The parameters Rsurplus, Gsurplus, Bsurplus are surplus signals indicative of a surplus on parameters Rs, Gs, Bs to which the red (R), green (G) and blue (B) sub-pixels are not able to respond. Moreover, the gamma-corrected output drive signals RP, GP, BP and WP are thereby provided with a standard gamma pre-correction. Conveniently, the step (s) can be combined with a gamma mapping from a standard gamma pre-corrected signal to a specific LCD gamma factor.

More optionally, in the method, the multiplying coefficients KR, KG, KB have numerical values substantially corresponding to 0.2125, 0.7154 and 0.0721 respectively, and the number of quantization steps Q is substantially equal to 255.

Optionally, the method is adapted to process the input signals for driving at least one of: a liquid crystal display (LCD), and a digital micromirror device (DMD).

According to a second aspect of the invention, there is provided an apparatus for driving a display including an array of display elements, each element comprising sub-pixels of red, green, blue and white colors, said apparatus comprising a processor operable:

(a) to receive input signals for controlling red, green and blue colors of each element of the display;

(b) to process the input signals to generate corresponding red, green, blue and white output drive signals for the red, green, blue and white sub-pixels of each element, said output drive signals being enhanced according to a gain factor for increasing element luminosity subject to potential color saturation occurring at one or more of the elements being addressed by selectively reducing color saturation at said one or more of said elements; and (c) to apply said output drive signals to respective sub-pixels for each element of the display.

Optionally, in the apparatus, the display is implemented as a liquid crystal display (LCD) or a digital micromirror display (DMD).

According to third aspect of the invention, there is provided software executable on the processor of the apparatus for implementing the method, said apparatus and method being according to first and second aspect of the invention respectively.

It will be appreciated that features of the invention are susceptible to being combined in any combination without departing from the scope of the invention.

DESCRIPTION OF THE DIAGRAMS

Embodiments of the invention will now be described, by way of example only, with reference to the following diagrams wherein.

DESCRIPTION OF EMBODIMENTS OF THE INVENTION

Figure 1:
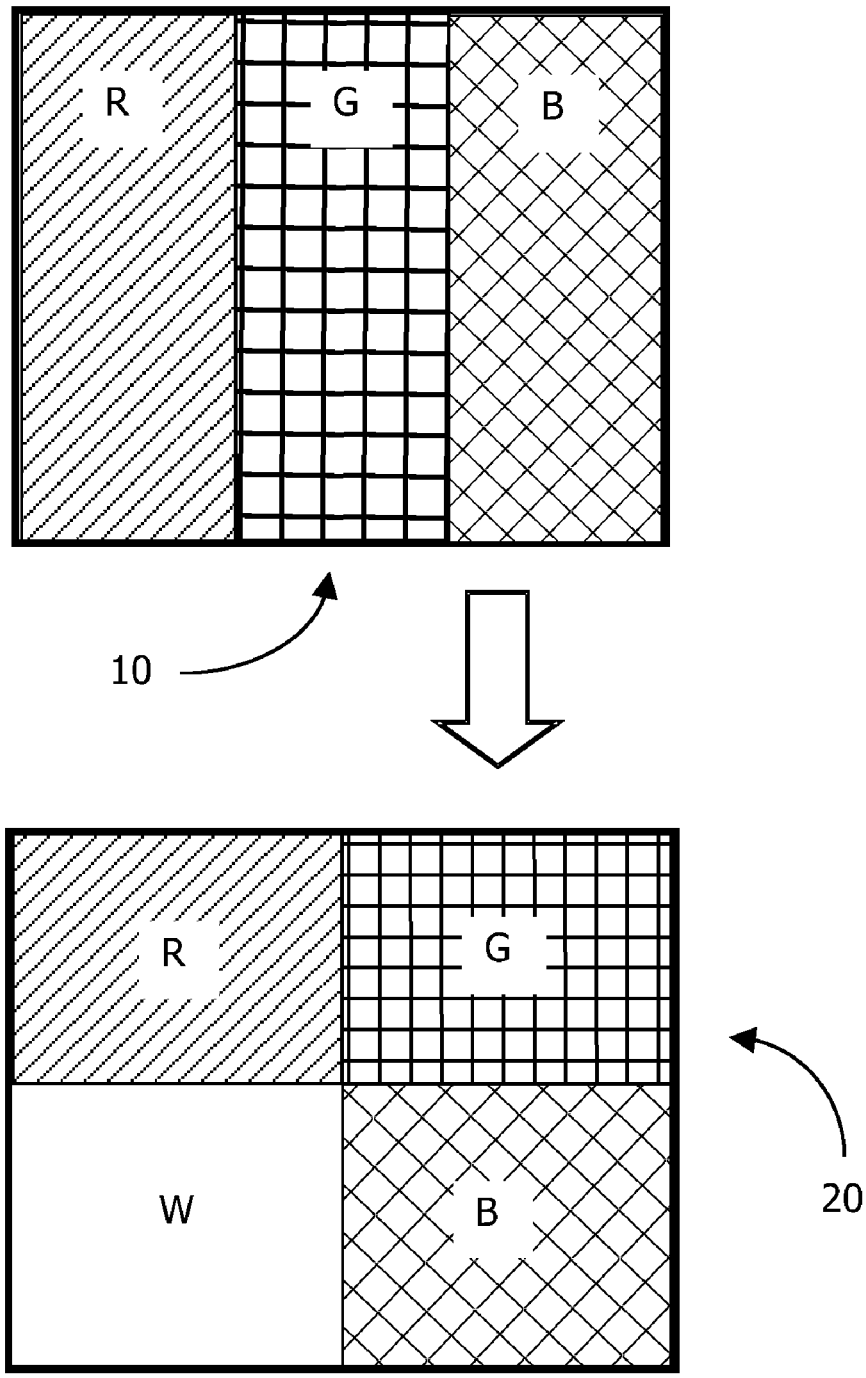
FIG.1 (PRIOR ART)
FIG. 1 is a schematic illustration of an element of a pixel display, one implementation of the element including red (R), green (G) and blue (B) sub-pixels only, in contradistinction to another implementation of the element including red (R), green (G), blue (B) and white (W) sub-pixels.

In the aforementioned known regimes for driving the element 20 in FIG. 1, for example as described by Equations 1 to 7, the inventors have appreciated that the input signals Ri, Gi, Bi are subject to a gamma characteristic of the display when driving the display. This gamma characteristic concerns a relationship between drive signal applied to the display and a corresponding optical effect achieved in the display. Moreover, the gamma characteristic is often a non-linear function. The inventors have appreciated that it is beneficial to pre-compensate the input signals Ri, Gi, Bi used to the drive the element 20 to account for gamma. However, when determining transmissions of light through the R, G, B, and W sub-pixels of the element 20, it is convenient to work with parameters having a linear relation to light transmission through the element 20, namely in a "linear light domain". It is known that conversion from a gamma domain to the linear light domain and vice versa when driving displays each including many thousands of elements requires complex conversion circuits. However, applying the aforementioned regimes whilst accounting for the aforesaid gamma characteristic often yields substantially acceptable presented image quality, especially for the aforementioned Min−1, Min−2, Min−3 regimes. However, the aforesaid MaxW regime generates unacceptable color hues to images presented using a display comprising an array of the elements 20. Having appreciated such problems arising on account of the gamma characteristics, the inventor has devised the present invention now to be further elucidated by way of describing various embodiments of the invention.

In devising at least a partial solution to the aforementioned known technical problems, the inventors have devised a method of driving the element 20, wherein the method utilizes an algorithm known as a "high gain" algorithm. The high gain algorithm attempts to increase overall gain, thereby providing an enhancement in brightness, whilst decreasing differences in gains for white and saturated colors.

In a regime adopted by Samsung as described in Equations 7, namely a variation of the aforementioned MaxW regime, the gain utilized is as provided in Equation 8 (Eq. 8):

$$\text{Gain}=1+\text{Min}/(\text{Max}-\text{Min}) \text{ such that Gain is limited to a value } 1+w \qquad \text{Eq. 8}$$

It is convenient to define a parameter $T_W$ to describe light transmission through the white (W) sub-pixel of the element 20, and also to define a parameter $T_{RBG}$ to described combined light transmission possible through the red (R), green (G) and blue (B) sub-pixels of the element 20. A further parameter A describes a ratio $T_W/T_{RBG}$ and does not necessarily correspond to a ratio of areas of the sub-pixels of the element 20, the parameter A being defined by Equation 9 (Eq. 9):

$$A=T_W/T_{RGB} \qquad \text{Eq. 9}$$

Typically, the parameter A will have a value in the order of unity. A maximum gain $GN_{max}$, namely optical transmission achievable through the entire element 20 relative to the RGB part of the element 20, is defined by Equation 10 (Eq. 10):

$$GN_{max}=T_{RGBW}/T_{RGB}=T_{RGB}/T_{RGB}+T_W/T_{RGB}=1+A \qquad \text{Eq. 10}$$

Moreover, when driving a display comprising an array of the elements 20, there is further utilized an additional gain parameter HS for coping with highly saturated colors and used to modulate a gain factor required for the elements 20 in the aforesaid display, such that an overall gain factor $GN_{effective}$ used for any given element in the display is defined by Equation 11 (Eq. 11):

$$GN_{effective}=HS[1+\text{Min}/(\text{Max}-\text{Min})] \text{ wherein } GN_{effective} \text{ is limited to a value of } 1+A=HS[\text{Max}/(\text{Max}-\text{Min}) \text{ wherein } GN_{effective} \text{ is limited to a value of } 1+A \qquad \text{Eq. 11}$$

wherein Min and Max are previously defined with reference to Equation 2 (Eq. 2) in the foregoing.

It is practical to limit HS in a range of 1 to 1+A. Thus, a typical value of the parameter HS in practice is 1.5. Moreover, use of the parameter HS results in a decreased variation in gain over a whole picture. Application of a method described by Equations 10 and 11, namely using the parameter HS to modulate gain utilized on colored regions of images having high brightness and high saturation, for example a red region having a total color output of Rt, Gt, Bt=255, 0, 0 respectively, may result in being mapped outside a color space possible using a display including an array of elements 20. Such bright saturated colors rarely occur in video program content and are processed by the method towards desaturated colors but having a correct luminance value.

Figure 2:
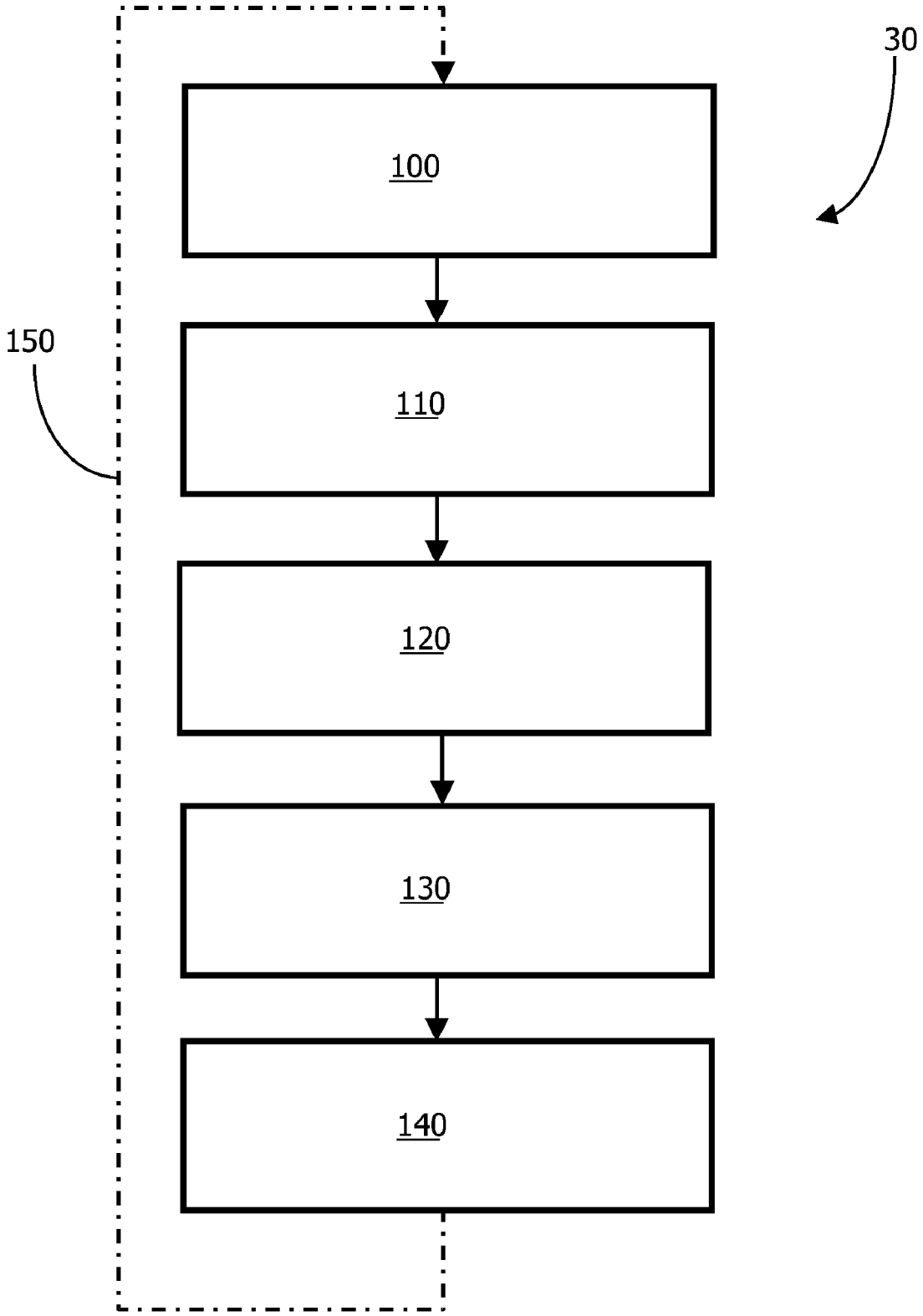
FIG. 2 is a flow chart indicating steps of a method of processing red (R), green (G), blue (B) input signals for each element of a display to generate appropriate drive signals for the element, said element including red (R), green (G), blue (B) and white (W) sub-pixels.

The method of the invention will be now further elucidated with reference to FIG. 2 wherein steps of the method are indicated generally by 30. The method includes steps 100 to 140 as defined in Table 1.

TABLE 1

| Feature | Definition |
|---|---|
| 100 | STEP 1: define gamma, γ |
| 110 | STEP 2: calculate gains |
| 120 | STEP 3: subtract a common signal |
| 130 | STEP 4: determine a maximum surplus and extract it |
| 140 | STEP 5: drive sub-pixels of the display element 20 |
| 150 | Loop back to refresh sub-pixels of the display element 20 for a subsequent image frame |

The method 30 is intended to be used on signals linearly representing intended light and color intensity, namely with linear light signals.

In STEP 1, input signals RI, GI, BI for driving the element 20 are provided in a scale of 0 to 255 and are beneficially scaled to a corresponding normalised range 0-1. After scaling, the scaled input signals are subject to gamma correction as described by Equations 12 (Eq. 12) for converting them from gamma-domain to linear-domain wherein RI, GI, BI denote gamma domain equivalent signals to the corresponding linear domain signals Ri, Gi, Bi respectively:

$$Ri=(RI/255)^{\gamma}$$

$$Gi=(GI/255)^{\gamma}$$

$$Bi=(BI/255)^{\gamma} \quad \text{Eqs. 12}$$

In STEP 2, a gain parameter is computed and the input signals Ri, Gi, Bi are multiplied by the gain parameter as described by Equations 13 (Eqs. 13):

$$\text{Max}=\max(Ri, Gi, Bi)$$

$$\text{Min}=\min(Ri, Gi, Bi)$$

$GN=HS*\text{Max}/(\text{Max}-\text{Min})$, wherein gain $GN$ is limited to $1+A$ $$Rg=GN*Ri$$

$$Gg=GN*Gi$$

$$Bg=GN*Bi \quad \text{Eqs. 13}$$

wherein max(x, y, z) returns a value corresponding to a maximum value amongst x, y, z;

min(x, y, z) returns a value corresponding to a minimum value amongst x, y, z; and determination of the gain parameter HS is as elucidated later.

In STEP 3, a common signal CM is derived which corresponds to a minimum of the parameters Rg, Gg, Bg computed in STEP 2. Thereafter, intermediate signals are computed as provided in Equations 14 (Eqs. 14):

$CM=\min(Rg, Gg, Bg, A)$ wherein A and min are previously defined $$Rs=Rg-CM$$

$$Gs=Gg-CM$$

$$Bs=Bg-CM \quad \text{Eqs. 14}$$

wherein values for signals Rs, Gs and/or Bs can potentially numerically be above a value of 1.

In STEP 4, a maximum value of surplus is computed which is then subsequently subtracted as described in Equations 15 (Eqs. 15):

$\text{Maxs}=\max(Rs, Gs, Bs)$, wherein max is previously defined

Surplus=Maxs−1, wherein Surplus is set to a value of zero if this computation of Surplus yields a negative value $$R\text{surplus}=Rs*[\text{Surplus}/\text{Maxs}]$$

$$G\text{surplus}=Gs*[\text{Surplus}/\text{Maxs}]$$

$$B\text{surplus}=Bs*[\text{Surplus}/\text{Maxs}]$$

$$Rp=Rs-R\text{surplus}$$

$$Gp=Rs-G\text{surplus}$$

$$Bp=Rs-B\text{surplus} \quad \text{Eqs. 15}$$

wherein parameters Rp, Gp, Bp are subsequently used in STEP 5 to drive the red (R), green (G), blue (B) sub-pixels respectively of the element 20.

In STEP 5, a luminance value for the white (W) sub-pixel of the element 20 is computed. Optionally, the luminance value for the white (W) sub-pixel is computed using a REC709 formula as described by Equation 16 (Eq. 16), although other formulae can be alternatively employed if desired:

$$Y\text{surplus}=(0.2125*R\text{surplus})+(0.7154*G\text{surplus})+(0.0721*B\text{surplus}) \quad \text{Eq. 16}$$

wherefrom a parameter Wp for controlling luminance of the white (W) sub-pixel can be computed from Equation 17 (Eq. 17):

$$Wp=(CM+Y\text{surplus})/A \quad \text{Eq. 17}$$

Signals RP, GP, BP, WP converted to the gamma domain for driving the red (R), green (G), blue (B), white (W) sub-pixels of the element 20 are then computable by applying Equations 18 (Eqs. 18) from results of Equations 15 and Equation 17:

$$RP=255*Rp^{1/\gamma}$$

$$GP=255*Gp^{1/\gamma}$$

$$BP=255*Bp^{1/\gamma}$$

$$WP=255*Wp^{1/\gamma} \quad \text{Eqs. 18}$$

Moreover, total output then provided by the element 20 in response to the output drive signals RP, GP, BP, WP can be determined from Equations 19 (Eqs. 19):

$$Rt=Rp+A*Wp$$

$$Gt=Gp+A*Wp$$

$$Bt=Bp+A*Wp \quad \text{Eqs. 19}$$

STEPS 1 to 5 are performed for each element 20 in each frame present on the display.

In overview, in executing STEPS 1 to 5, luminance reduction in one or more of the red (R), green (G), blue (B) sub-pixels is at least partially compensated by increase in luminance of the white (W) sub-pixel, subject to the color saturation being reduced should Surplus>0. STEPS 1 to 5 are arranged to yield a maximum value for the parameter Wp and thereby result in the display incorporating an array of elements 20 being as bright as possible. Moreover, optionally, the contribution of Rp, Gp, Bp is contrast to Wp can be changed, subject to Rt, Gt, Bt remaining unchanged thereby.

In operation, the method described in relation to STEPS 1 to 5 results in a degree of desaturation of high-brightness high-saturation colors. A degree of desaturation occurring is determined by the aforesaid parameter Ysurplus as computed in Equation 16 (Eq. 16). Beneficially, the gain parameter HS in Equations 13 (Eqs. 13) in the foregoing is adaptable in response to overflows occurring in the parameter Ysurplus, for example responsive to a number of elements in a given image being present in which overflow has occurred. An overflow occurs when Ys is above a predetermined threshold value. When the occurrence of overflows in the parameter Ysurplus in elements per image frame increases, a value used for the parameter HS is beneficially reduced, although the parameter HS is limited to a range of 1 to A as described in the foregoing; optionally, this reduction occurs when the number of elements experiencing overflow per image frame exceeds a predetermined threshold. Optionally, a given value of HS pertains to all elements in a given image frame presented on a display; alternatively, if desired, the parameter HS can be modified locally within a given image in response to overflow in Ysurplus occurring locally. More optionally, adaptive modification of the value of the parameter HS is implemented with hysteresis in response to the number of elements per image experiencing overflows so that frequent changes in color saturation do not occur in a series of presented images.

Figure 3:
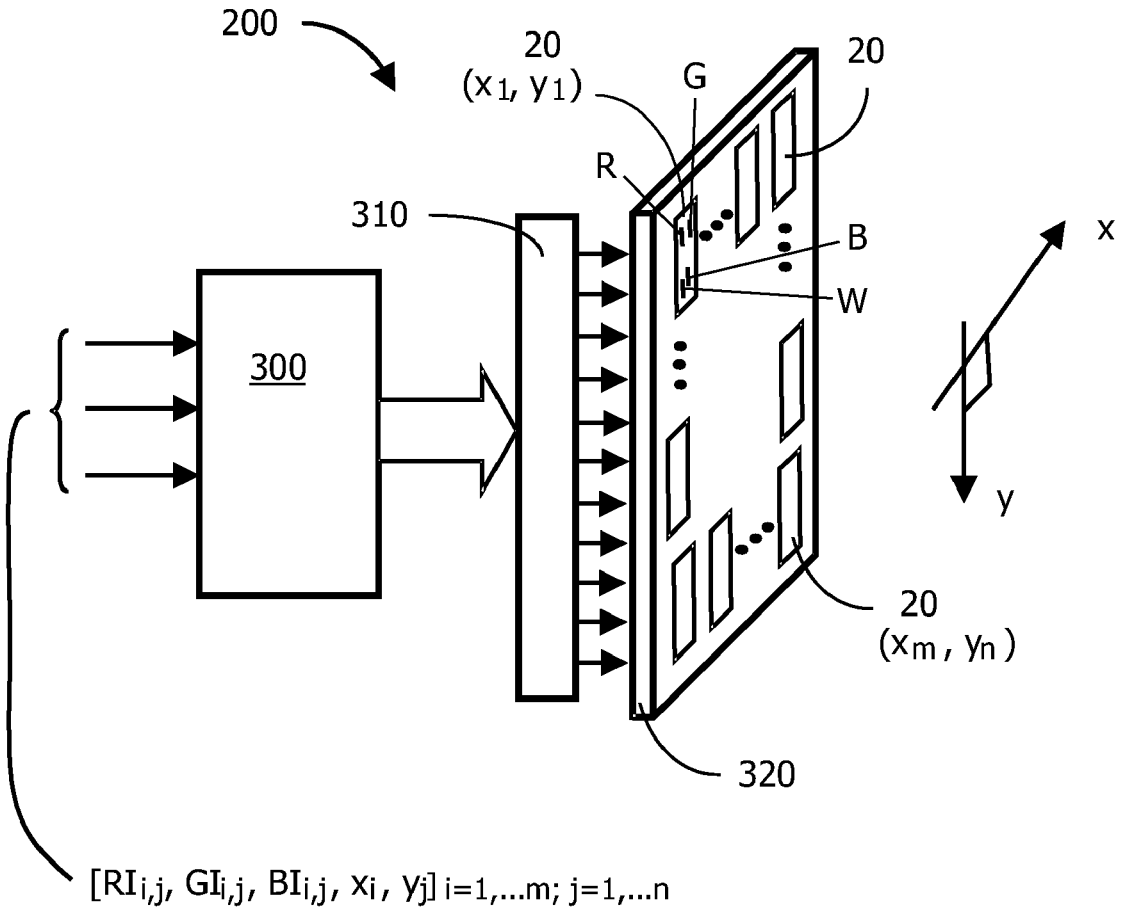
FIG. 3 is a schematic diagram of apparatus configured to employ the method depicted in FIG. 2 for driving elements of an image display.

Apparatus for implementing the method described depicted in FIG. 2 will now be described with reference to FIG. 3. In FIG. 3, the apparatus is indicated generally by 200 and includes a processor 300 for receiving red (R), green (G), blue (B) input information for each element 20 in an array of such elements forming an image display 320 for presenting images to a user. Optionally, a single processor is used to sequentially process signals for all the sub-pixels. Processed output signals from the processor 300, such signals being generated by the method described with reference to FIG. 2, are passed via driver hardware 310 to drive the individual elements 20 of the display 320. Each element 20 of the display 320 is configured with red (R), green (G), blue (B) and white (W) sub-pixels as illustrated in FIG. 1. The elements 20 of the display 320 are disposed in m columns and n rows disposed along x and y axes respectively as shown. The method illustrated in FIG. 2 is applied to RI, GI, BI signals of each individual element 20 of the display 320. Optionally, the processor 300 can be implemented using computing hardware and/or custom logic hardware, for example an application specific integrated circuit (ASIC).

Figure 4:
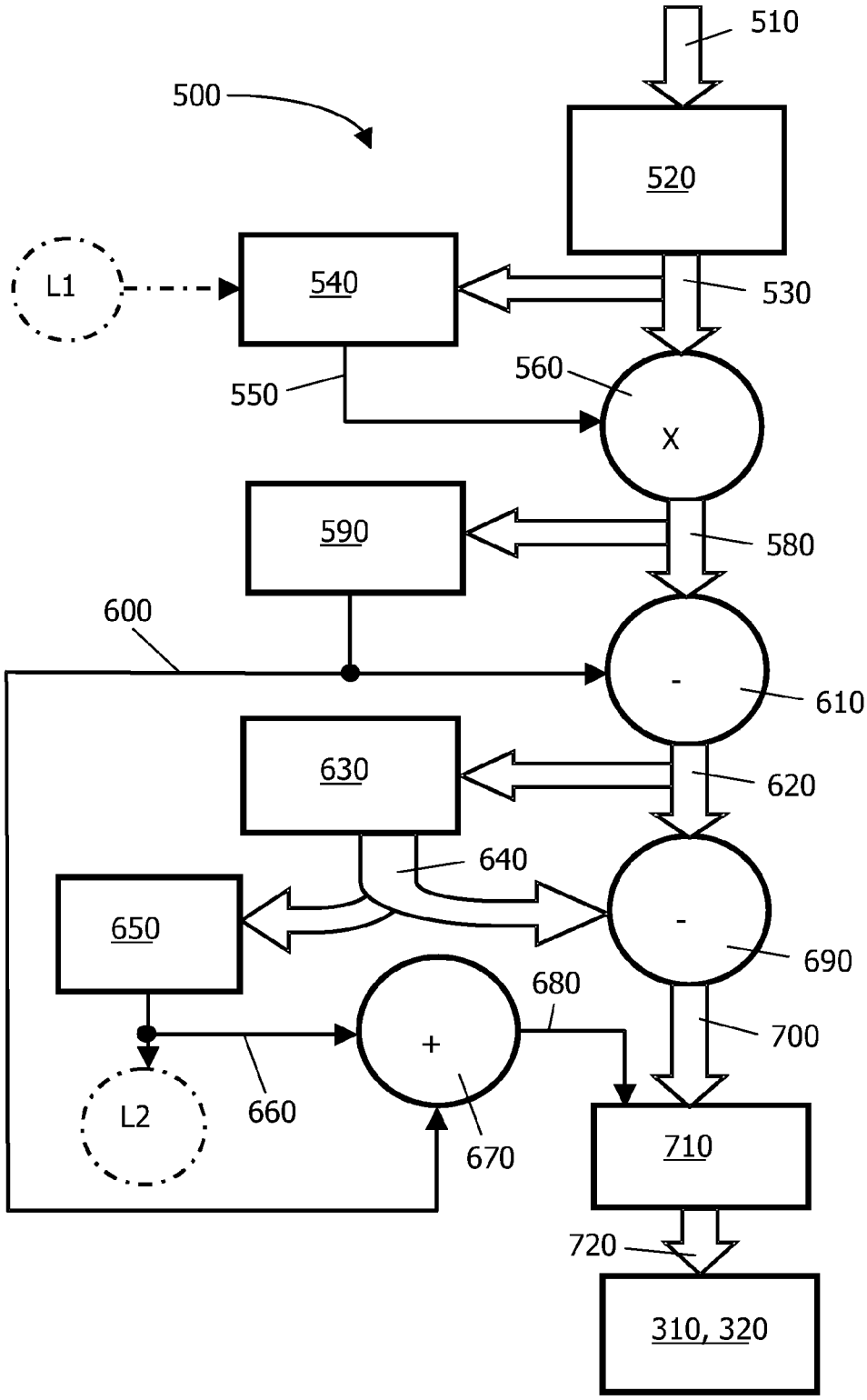
FIG. 4 is a schematic diagram of processing steps executed in the apparatus depicted in FIG. 3.

Functions performed within the processor 300 are depicted in FIG. 4 and are indicated generally by 500; numbered features in FIG. 4 are to be interpreted with reference to Table 2.

TABLE 2

| Feature | Interpretation |
|---|---|
| 510 | RGB-I color input signals in gamma domain |
| 520 | Function to de-gamma RGB-I to generate $RGB^{\gamma}$; see Equations 11, STEP 1 |
| 530 | Linear domain color signals RGB-i; STEP 1 |
| 540 | Function to compute gain HS* (Max/(Max-Min)) wherein 1 < HS < A; see Equations 13 |
| 550 | RGB-g gain as computed from Equations 13 |
| 560 | Multiplying function to compute GN*Ri, GN*Gi, GN*Bi in Equations 13 |
| 580 | RGB-g signals as generated by Equations 13 |
| 590 | Function to compute the common signal CM as defined in Equations 14 |
| 600 | Common signal CM as in Equations 14 |
| 610 | Subtraction function to subtract the common signal CM as in Equations 14 |
| 620 | RGB-s signals as computed from Equations 14 |
| 630 | Function to compute surplus RGB-surplus as in Equations 15 |
| 640 | RGB-surplus as computed from Equations 15 |
| 650 | Function to compute Ysurplus as in Equation 16 |
| 660 | Ysurplus as computed using Equation 16 in the function 650 |
| 670 | Function to compute Wp as in Equation 17 |
| 680 | Computed value for parameter Wp from Equation 17 |
| 690 | Subtraction function to generate RGP-p as in Equations 15 |
| 700 | RGB-p parameter values as computed from Equations 15 |
| 710 | Function to apply gamma correction as in Equations 18 |
| 720 | Gamma-corrected RGB drive signals of sub-pixels RGBW of the element 20 |

Figure 5:
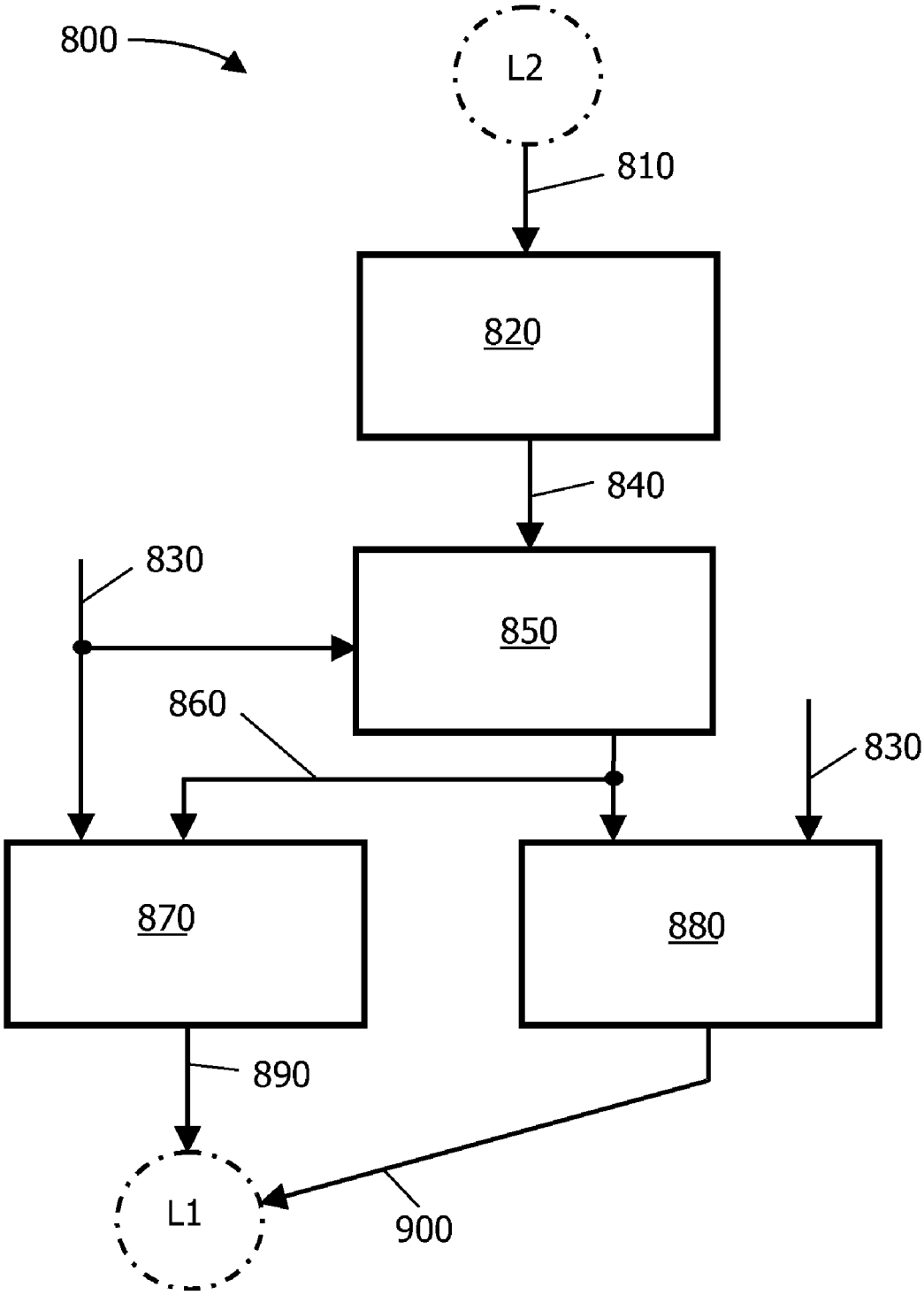
FIG. 5 is a schematic diagram of an optional additional part of the apparatus for providing adaptive gain in response to number of occurrences of color saturation at elements.

The functions 500 illustrated in FIG. 4 provide a graphical illustration of a relationship between Equations 12 to 18 as provided in STEPS 1 to 5 described in the foregoing, these functions 500 constituting an embodiment of the present invention. Optionally, the functions 500 are supplemented with adaptive control of the gain HS as used in Equations 13, wherein the functions 500 are executed in combination with further functions indicated generally by 800 as depicted in FIG. 5 whose interpretation is provided in Table 3. Parameters L1, L2 are included merely to indicate a manner in which the functions 500, 800 are intercoupled.

TABLE 3

| Feature | Interpretation |
|---|---|
| 810 | Ysurplus parameter 660 computed by the function 650 as in Equation 16 |
| 820 | Function to compare the Ysurplus parameter with a threshold on an element-by-element basis; if Ysurplus > threshold, an overflow is identified indicative of color desaturation by the algorithm |
| 830 | Video synchronisation signal Vsync indicative of image sequence |
| 840 | Overflow detection output signal from the function 820 |
| 850 | Function to count number of overflows per image frame from the function 820; the function 850 is reset in response to the signal Vsync defining start of image frame |
| 860 | Count of number of elements experiencing overflow in Ysurplus per frame |
| 870 | Comparing function for decrementing the gain parameter HS in response to too many occurrences of Ysurplus overflow above the threshold |
| 880 | Comparing function for incrementing the gain parameter HS in response to too few Ysurplus overflows above the threshold |
| 890 | Decrement gain HS signal |
| 900 | Increment gain HS signal |

The functions 500, 800 are implemented in a sequence as depicted in FIGS. 4 and 5, and are implemented repetitively for each sub-pixel with regard to the functions 500 and on an image frame-by-frame basis for the functions 800, namely the gain HS is incremented or decremented, as appropriate, on an image frame-by-frame basis.

In summary, luminance is improved by an addition of the white (W) sub-pixel to red (R), green (G) and blue (B) sub-pixels of the element 10 to provide the element 20. In prior art methods of driving the element 20, a white (W) signal for controlling optical properties of the white (W) sub-pixel is based on a common part of RGB signals in such a way that color hue and saturation are maintained. Rendition of saturated colors in such prior art methods where such saturated colors have little or no common part does not benefit from inclusion of the white (W) sub-pixel. The method of the present invention adds luminance based on the common part of the RGB signals, whilst adding luminance to saturated colors by desaturating them in a limited way. As a consequence of employing the method of the present invention, the enhanced luminance of saturated colors and hence improved ratio to enhanced unsaturated colors outweighs any artefacts introduced due to desaturation of colors arising, thereby providing more optimal display presentations to viewers.

It will be appreciated that embodiments of the invention described in the foregoing are susceptible to being modified without departing from the scope of the invention as defined by the accompanying claims.

The present invention is not limited to liquid crystal displays (LCDs) but is also applicable to driving micro-mirror arrays employed for projecting images; such arrays are referred to as digital micromirror devices (DMDs). Such arrays are described in a published U.S. Pat. No. 5,592,188 granted to Texas Instruments Inc. which is hereby incorporated by reference. Methods of high gain with selective control of saturation as described in the foregoing is applicable to controlling actuation time of DMDs illuminated with red, green blue and white light filtered through a color wheel including a white segment or generated from temporally alternatingly energized colored light sources, for example high-brightness light emitting diodes (LEDs). A time duration during which individual micromirrors are actuated when illuminated with a given color of light is used to modulate color and brightness of various spatial parts of image generated from these micromirrors. Thus, the duration that the micromirrors are actuated can be controlled by methods of the invention described in the foregoing and claimed in the appended claims.

The invention is also applicable to displays fabricated from arrays of elements wherein each element is individually addressable and comprises light emitting diodes of red, blue, green and white colors. In another related example, the invention is applicable to displays fabricated from arrays of elements implemented with vertical-cavity surface-emitting lasers which are optionally individually addressable, such lasers often being referred to as VCSELs, which are capable of exhibiting relatively high quantum efficiency when emitting radiation therefrom. VCSELs are described in a U.S. Pat. No. US2002/0150092 which is hereby incorporated by reference. Moreover, the present invention is also capable of being implemented in conjunction with organic LED (OLED) displays.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method of driving a display including an array of display elements, each element comprising red, green, blue and white colors, said method comprising the steps of:

(a) receiving input signals for controlling red, green and blue colors of each element of the display;

(b) processing the input signals to generate corresponding red, green, blue and white output drive signals for the red, green, blue and white sub-pixels of each element, said output drive signals being enhanced according to a gain factor for increasing element luminosity subject to potential color saturation occurring at one or more of the elements being addressed by selectively reducing color saturation at said one or more of said elements; and (c) applying said output drive signals to respective sub-pixels for each element of the display, wherein processing in step (b) comprises the steps of:

(d) computing for each element a maximum potential optical transmission therethrough;

(e) scaling the input signals for each element according to the maximum optical transmission therethrough computed in step (d);

(f) computing a minimum value of the scaled input signals from step (e);

(g) computing intermediate signals for the scaled input signals from step (e) in relation to the minimum value from step (f) for each element;

(h) computing a maximum value of the computed intermediate signals from step (g) for each element;

(i) computing surpluses from step (g) in relation to the maximum value from step (h) for each element;

(j) computing a difference between the computed surpluses from step (i) in relation to the intermediate signals from step (g) to generate output drive signals for the red, green and blue sub-pixels of each element;

(k) computing a luminance value from the scaled computed surplus from step (i) and the minimum value from step (f); and (l) applying the luminance value from step (k) to generate the white output drive signal to control optical output of the white sub-pixel, and applying the output drive signals from step (j) to control optical output from the red, green and blue sub-pixels for each element.

2. A method as claimed in claim 1, wherein the gain factor in step (b) is made adaptive in response to the number of elements whereat color desaturation occurs.

3. A method as claimed in claim 2, wherein the gain factor in step (b) is adaptively modified on an image frame-by-frame basis as presented on the display.

4. A method as claimed in claim 3, wherein the gain factor is adaptively modified in a progressive incremented or decremented manner.

5. A method as claimed in claim 3, wherein the gain factor is progressively incremented or decremented with hysteresis.

6. A method as claimed in claim 2, wherein said processing in step (b) is substantially executed pursuant to computations comprising:

(m) converting the input signals RI, GI, BI for red, green and blue colors respectively from the gamma-domain to corresponding parameters Ri, Gi, Bi respectively in the linear domain pursuant to:

$$Ri=(RI/Q)^{+65};\ Gi=(GI/Q)^{+65};\ Bi=(BI/Q)^{+65}$$

wherein Q is a number of quantization steps employed;

(n) multiplying by the gain parameter in step (b) to generate signals Rg, Gg and Bg:

Max=max(Ri, Gi, Bi) wherein max returns a maximum value amongst its arguments;

Min=min(Ri, Gi, Bi) wherein min returns a minimum value amongst its arguments;

$$GN=HS*\mathrm{Max}/(\mathrm{Max}-\mathrm{Min}),$$

wherein HS is the gain factor in step (b) and GN is limited to a value 1+A wherein GN<1+A wherein a parameter A is a relative optical transmission of the white sub-pixel relative to the sum of the red, blue and green sub-pixels $$Rg=GN*RI\ Gg=GN*Gi\ Bg=GN*Bi;$$

(o) computing a common signal CM and therefrom signals Rs, Gs, Bs for red, green and blue colors respectively:

$CM=\min(Rg, Gg, Bg, A)$ wherein min returns a minimum value of its arguments $$Rs=Rg-CM\ Gs=Gg-CM\ Bs=Bg-CM;$$

(p) computing a maximum surplus value and performing subtractions of the surplus signals from step (m) to generate signals Rp, Gp, Bp for red, green and blue colors respectively:

$\mathrm{Max}s=\max(Rs, Gs, Bs)$

Surplus=Max$s$−1, wherein Surplus is set to zero if calculated to be less than zero $Rsurplus=Rs*(\mathrm{Surplus}/\mathrm{Max}s)$ $$Gsurplus=Gs*(Surplus/Maxs)$$

$$Bsurplus=Bs*(Surplus/Maxs)$$

$$Rp=Rs-Rsurplus\ Gp=Rs-Gsurplus\ Bp=Rs-Bsurplus;$$

(q) computing a Ysurplus signal pursuant to:

$$Ysurplus=KR*Rsurplus+KG*Gsurplus+KB*Bsurplus$$

wherein KR, KG and KB are multiplying coefficients for red, green and blue colors respectively;

(r) computing a signal Wp for controlling luminance of the white sub-pixel:

$$Wp=(CM+Ysurplus)/A;\text{ and}$$

(s) computing the output drive signals RP, GP, BP, WP to control optical properties of the red, green, blue and white sub-pixels respectively, said output drive signals being in the gamma-domain pursuant to:

$$RP=Q*Rp^{1/+65}GP=Q*Gp^{1/+65}BP=Q*Bp^{1/+65}WP=Q*Wp^{1/+65}.$$

7. A method as claimed in claim 6, wherein the multiplying coefficients KR, KG, KB have numerical values substantially corresponding to 0.2125, 0.7154 and 0.0721 respectively, and the number of quantization steps Q is substantially equal to 255.

8. A method as claimed in claim 1, including a further step of converting the input signals from a gamma-domain to a linear domain for processing in step (b) and converting the output drive signals from the linear domain to the gamma-domain for driving the sub-pixels for each element.

9. A method as claimed in claim 1, said method being adapted to process the input signals for driving at least one of: a liquid crystal display (LCD), and a digital micromirror device (DMD).

10. An apparatus for driving a display including an array of display elements, each element comprising sub-pixels of red, green, blue and white colors, said apparatus comprising a processor operable:

(a) to receive input signals for controlling red, green, and blue colors of each element of the display;

(b) to process the input signals to generate corresponding red, green, blue and white output drive signals for the red, green, blue and white sub-pixels of each element, said output drive signals being enhanced according to a gain factor for increasing element luminosity subject to potential color saturation occurring at one or more of the elements being addressed by selectively reducing color saturation at said one or more of said elements; and (c) to apply said output drive signals to respective sub-pixels for each element of the display, wherein to process the input signals as in (b), the processor is further operable:

(d) to compute for each element a maximum potential optical transmission therethrough;

(e) to scale the input signals for each element according to the maximum optical transmission therethrough computed in operation (d);

(f) to compute a minimum value of the scaled input signals from operation (e);

(g) to compute intermediate signals for the scaled input signals from operation (e) in relation to the minimum value from operation (f) for each element;

(h) to compute a maximum value of the computed intermediate signals from operation (g) for each element;

(i) to compute surpluses from step (g) in relation to the maximum value from operation (h) for each element;

(j) to compute a difference between the computed surpluses from operation (i) in relation to the intermediate signals from operation (g) to generate output drive signals for the red, green and blue sub-pixels of each element;

(k) to compute a luminance value from the scaled computed surplus from operation (i) and the minimum value from operation (f); and (l) to apply the luminance value from operation (k) to generate the white output drive signal to control optical output of the white sub-pixel, and applying the output drive signals from operation (j) to control optical output from the red, green and blue sub-pixels for each element.

11. An apparatus as claimed in claim 10, wherein the display is implemented as a liquid crystal display (LCD) or a digital micromirror display (DMD).

* * * * *